US009611130B2

(12) United States Patent
Koteski et al.

(10) Patent No.: US 9,611,130 B2
(45) Date of Patent: Apr. 4, 2017

(54) METHOD AND APPARATUS FOR PROVIDING A BASE FOR A JACK

(71) Applicants: Gregory Michael Koteski, Newport News, VA (US); Eric Salci, Newcastle, CA (US); Gregg R. Rossi, Zephr Cove, NV (US)

(72) Inventors: Gregory Michael Koteski, Newport News, VA (US); Eric Salci, Newcastle, CA (US); Gregg R. Rossi, Zephr Cove, NV (US)

(73) Assignee: HARD CORE TRAIL GEAR, LLC, Zephyr Cove, NV (US)

( * ) Notice: Subject to any disclaimer, the term of this patent is extended or adjusted under 35 U.S.C. 154(b) by 108 days.

(21) Appl. No.: 14/714,843

(22) Filed: May 18, 2015

(65) Prior Publication Data

US 2016/0340164 A1 Nov. 24, 2016

(51) Int. Cl.
*B66F 13/00* (2006.01)
*B66F 1/00* (2006.01)

(52) U.S. Cl.
CPC ..... *B66F 13/00* (2013.01); *B66F 1/00* (2013.01)

(58) Field of Classification Search
CPC ..... B66F 13/00; B66F 1/00
USPC ..... 254/105
See application file for complete search history.

(56) References Cited

U.S. PATENT DOCUMENTS 1,552,901 A * 9/1925 Wengraf ..... B66F 13/00 248/352
1,903,341 A 4/1933 Mitchell
2,022,636 A * 11/1935 Faucett ..... B66F 13/00 254/1
2,351,611 A * 6/1944 Hammond ..... B66F 13/00 188/67
2,416,848 A * 3/1947 Rothery ..... B66F 13/00 248/170
2,493,978 A 1/1950 Kromer
2,931,463 A 4/1960 Stansbury et al.
4,203,577 A * 5/1980 Hafner ..... B66F 13/00 254/100
4,474,387 A 10/1984 Maranell et al.
5,505,524 A * 4/1996 Drumwright ..... A47C 1/04 248/169
6,874,745 B1 4/2005 Bean
7,137,608 B2 * 11/2006 Willey ..... F16M 11/00 248/168
D577,648 S 9/2008 Shaw
(Continued)

*Primary Examiner* — George Nguyen
(74) *Attorney, Agent, or Firm* — Walter J. Tencza, Jr.

(57) ABSTRACT

An apparatus including a lifting jack having a beam, and a base having a first section with a first opening configured to receive the beam. The base may further include one or more foundation plates connected to the first section in a manner so that each of the one or more foundation plates can be rotated with respect to the first section. The one or more foundation plates may include a first, second, third, and fourth foundation plates. The first foundation plate and the second foundation plate may be about the same size and shape. The third foundation plate and the fourth foundation plate may be about the same size and shape. The first foundation plate and the third foundation plate may be substantially different in size. Each of the one or more foundation plates may have a bottom surface, from which protrude a plurality of protrusions.

20 Claims, 15 Drawing Sheets

(56) References Cited

U.S. PATENT DOCUMENTS

| | | | | |
|---|---|---|---|---|
| 8,141,827 | B2 * | 3/2012 | Lin | F16M 11/242 248/170 |
| 2005/0017223 | A1 | 1/2005 | Lucas | |

* cited by examiner

METHOD AND APPARATUS FOR PROVIDING A BASE FOR A JACK

FIELD OF THE INVENTION

This invention relates to improved methods and apparatus for providing a base for a mechanical device used for lifting heavy loads, such as a car jack or a farm jack.

BACKGROUND OF THE INVENTION

Jacks or mechanical devices for lifting heavy loads are known.

SUMMARY OF THE INVENTION

One or more embodiments of the present invention provide a base for a jack, such as a base for a farm jack. The base improves stability, safety, and flexibility of the jack it is used with and improves a jack's stowing and storage options.

In at least one embodiment, an apparatus is provided comprising a lifting jack having a beam, and a base having a first section with a first opening configured to receive the beam. The base may further include one or more foundation plates connected to the first section in a manner so that each of the one or more foundation plates can be rotated with respect to the first section.

The one or more foundation plates may include a first foundation plate, a second foundation plate, a third foundation plate, and a fourth foundation plate. The first foundation plate and the second foundation plate may be about the same size and shape. The third foundation plate and the fourth foundation plate may be about the same size and shape. The first foundation plate and the third foundation plate may be substantially different in size. Each of the one or more foundation plates may have a bottom surface, from which protrude a plurality of protrusions.

The apparatus may further include one or more intermediate plates corresponding to the one or more foundation plates, such that there is one intermediate plate for each foundation plate. Each intermediate plate of the one or more intermediate plates may be fixed to the first section so that each intermediate plate cannot rotate with respect to the first section. Each intermediate plate may be connected to its corresponding foundation plate so that its corresponding foundation plate can rotate with respect to its intermediate plate and with respect to the first section. The one or more intermediate plates may include a first, a second, a third, and a fourth intermediate plate corresponding to the first, the second, the third, and the fourth foundation plates, respectively. Each of the one or more intermediate plates may include protrusions. The protrusions of each of the one or more intermediate plates may include triangular spikes.

Each of the intermediate plates may have at least one notch which allows its corresponding foundation plate to be snapped into at least one orientation with respect to the intermediate plate and with respect to the first section. The apparatus may include one or more further plates fixed to the one or more foundation plates, such that there is one further plate for each corresponding foundation plate. Each of the one or more further plates may be fixed substantially perpendicular to its corresponding foundation plate. Each of the one or more further plates may be connected to a corresponding one of the one or more intermediate plates so that the one or more further plates can rotate with respect to its corresponding one of the one or more intermediate plates, and with respect to the first section. Each of the one or more further plates may include a slot having a ball and a spring. The ball of each of the one or more further plates may snap into the at least one notch of the corresponding one of the one or more intermediate plates by action of the spring, in order to snap the corresponding one of the one or more foundation plates into the at least one orientation with respect its corresponding intermediate plate and with respect to the first section.

In at least one embodiment, a method is provided which includes placing a base of an apparatus on a ground surface; wherein the apparatus includes a lifting jack having a beam; and further comprising using the lifting jack to lift up a vehicle while the base of the apparatus is on the ground surface. The apparatus may be of a form as previously described.

DETAILED DESCRIPTION OF THE DRAWINGS

Figure 1A:
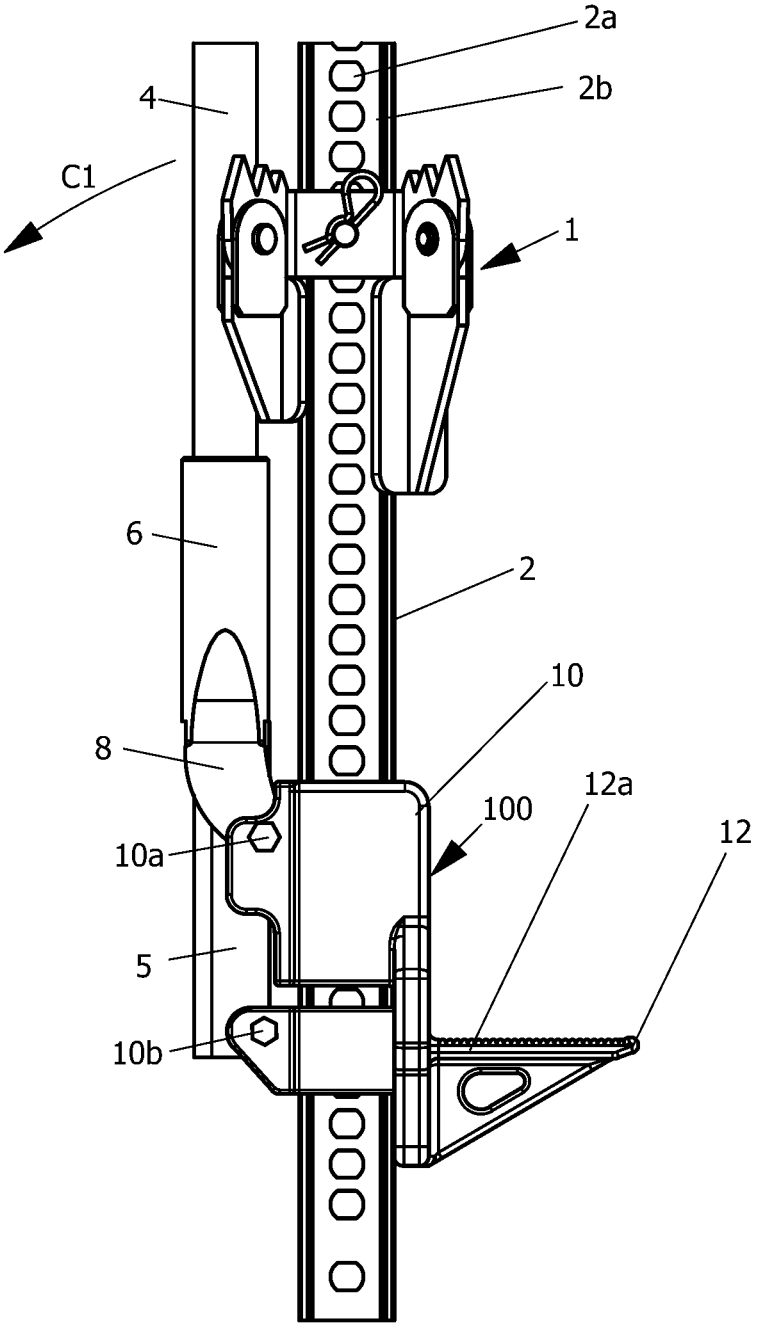
FIG. 1A shows a front view of a farm jack and base in accordance with an embodiment of the present invention, with the base in a folded downwards state.
Figure 1B:
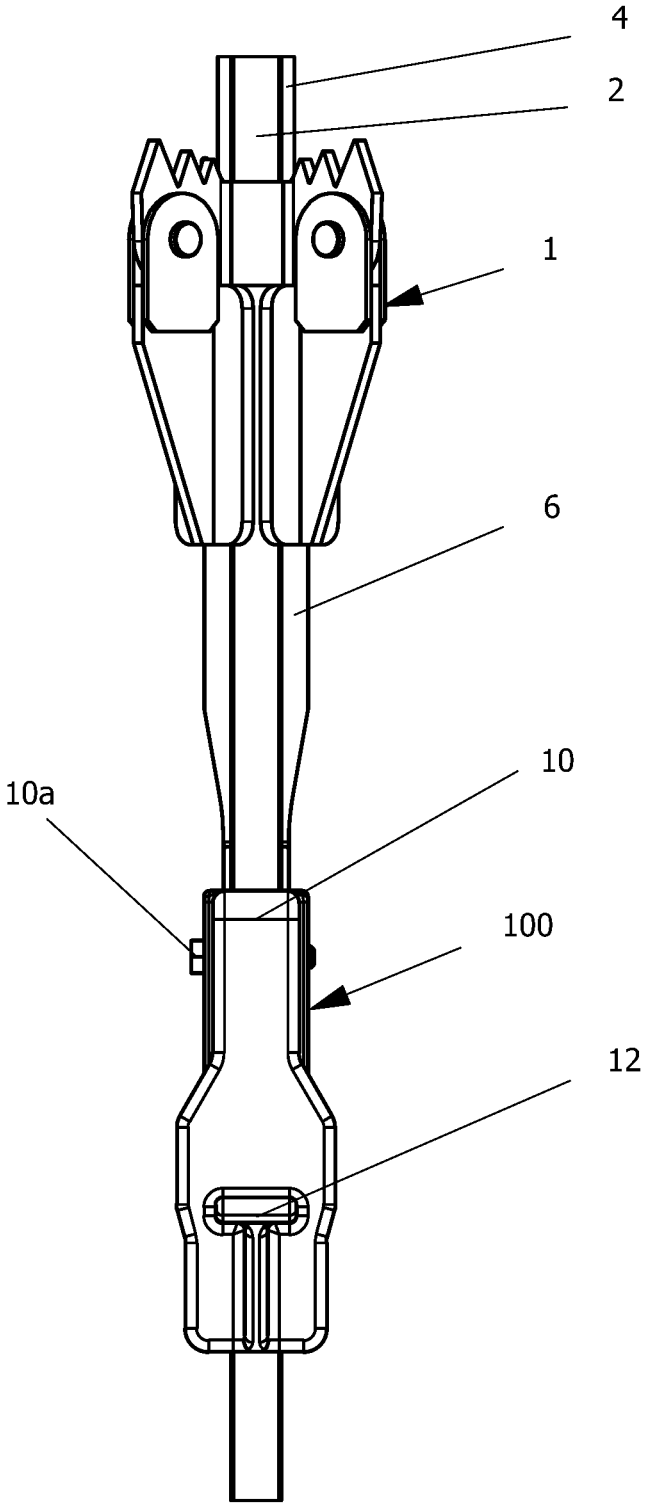
FIG. 1B shows a side view of the farm jack and the base of FIG. 1A, with the base in the folded down state as in FIG. 1A.
Figure 1C:
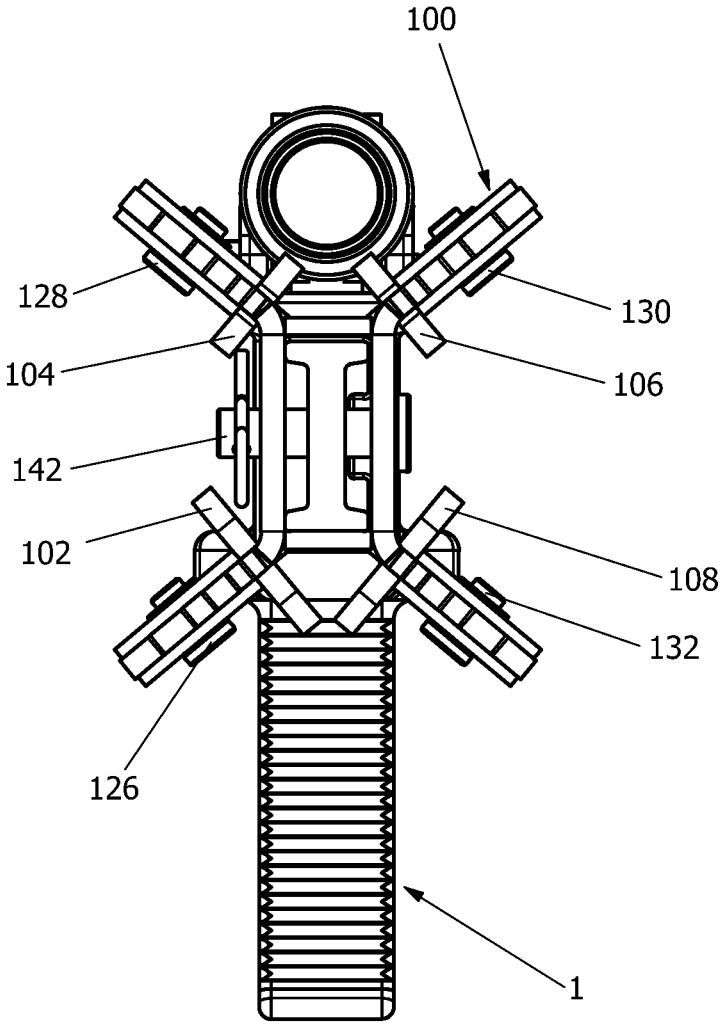
FIG. 1C shows a top view of the farm jack and the base of FIG. 1A, with the base in the folded down state as in FIG. 1A.

FIG. 1A shows a front view of a farm jack 1 and base 100 in accordance with an embodiment of the present invention, with the base 100 in a folded downwards state. FIG. 1B shows a side view of the farm jack 1 and the base 100 of FIG. 1A, with the base 100 in the folded down state as in FIG. 1A. FIG. 1C shows a top view of the farm jack 1 and the base 100 of FIG. 1A, with the base 100 in the folded down state as in FIG. 1A.

Figure 2:
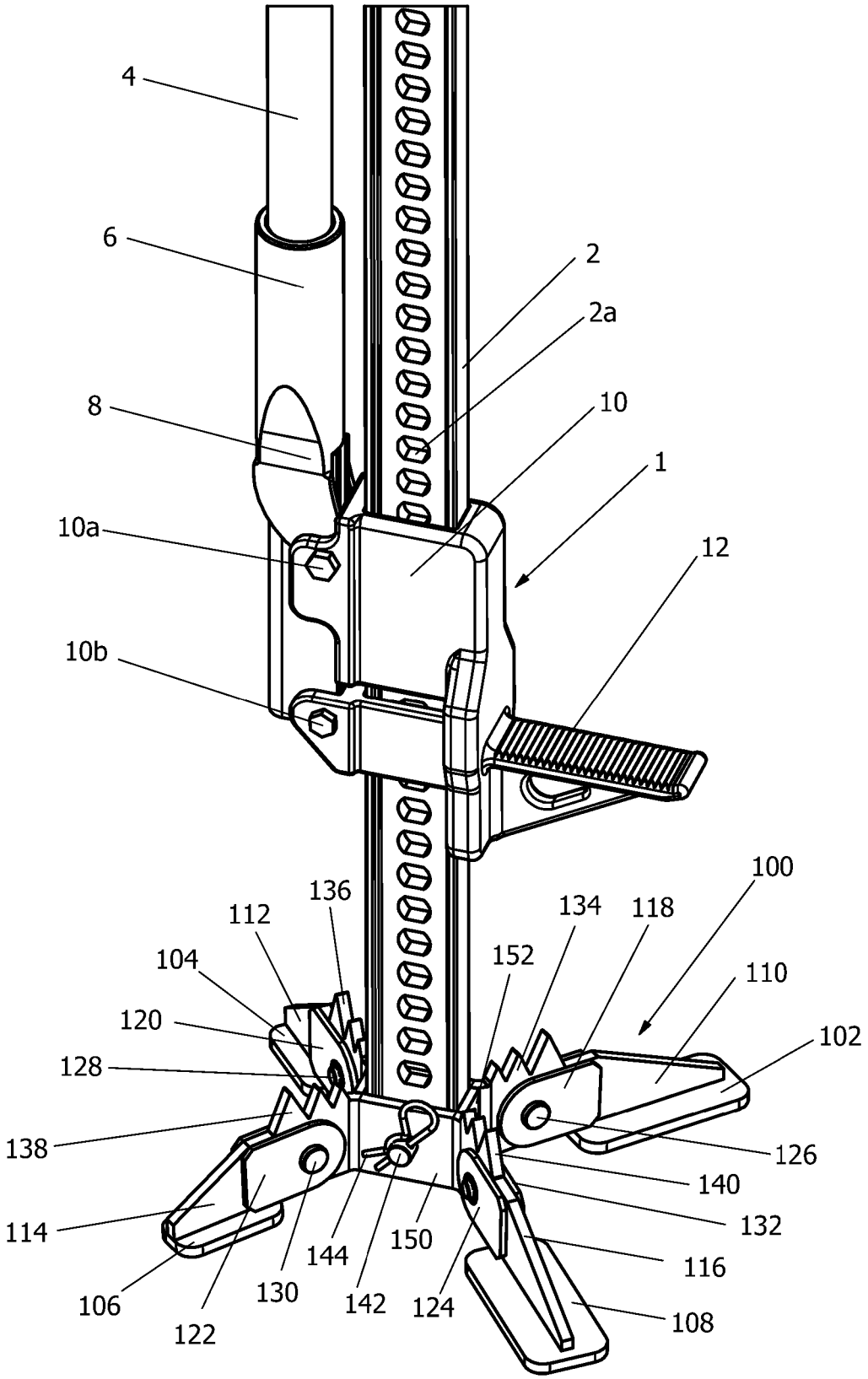
FIG. 2 shows a front, right side, and top perspective view of part of the farm jack of FIG. 1A and of the base of FIG. 1A, with the base of FIG. 1A in a flattened state, and placed on the farm jack so that two large plates of the base are situated to the right side of the farm jack and two small plates of the base situated to the left side of the farm jack, and with the base on a ground surface.

FIG. 2 shows a front, right side, and top perspective view of part of the farm jack 1 of FIG. 1A and of the base 100 of FIG. 1A, with the base 100 of FIG. 1A in a flattened state, and placed on the farm jack 1 so that two large plates 102 and 108 of the base 100 are situated to the right side of the farm jack 1 and two small plates 104 and 106 of the base 100 are situated to the left side of the farm jack 1, and with the base 100 on a ground surface 200.

Figure 3:
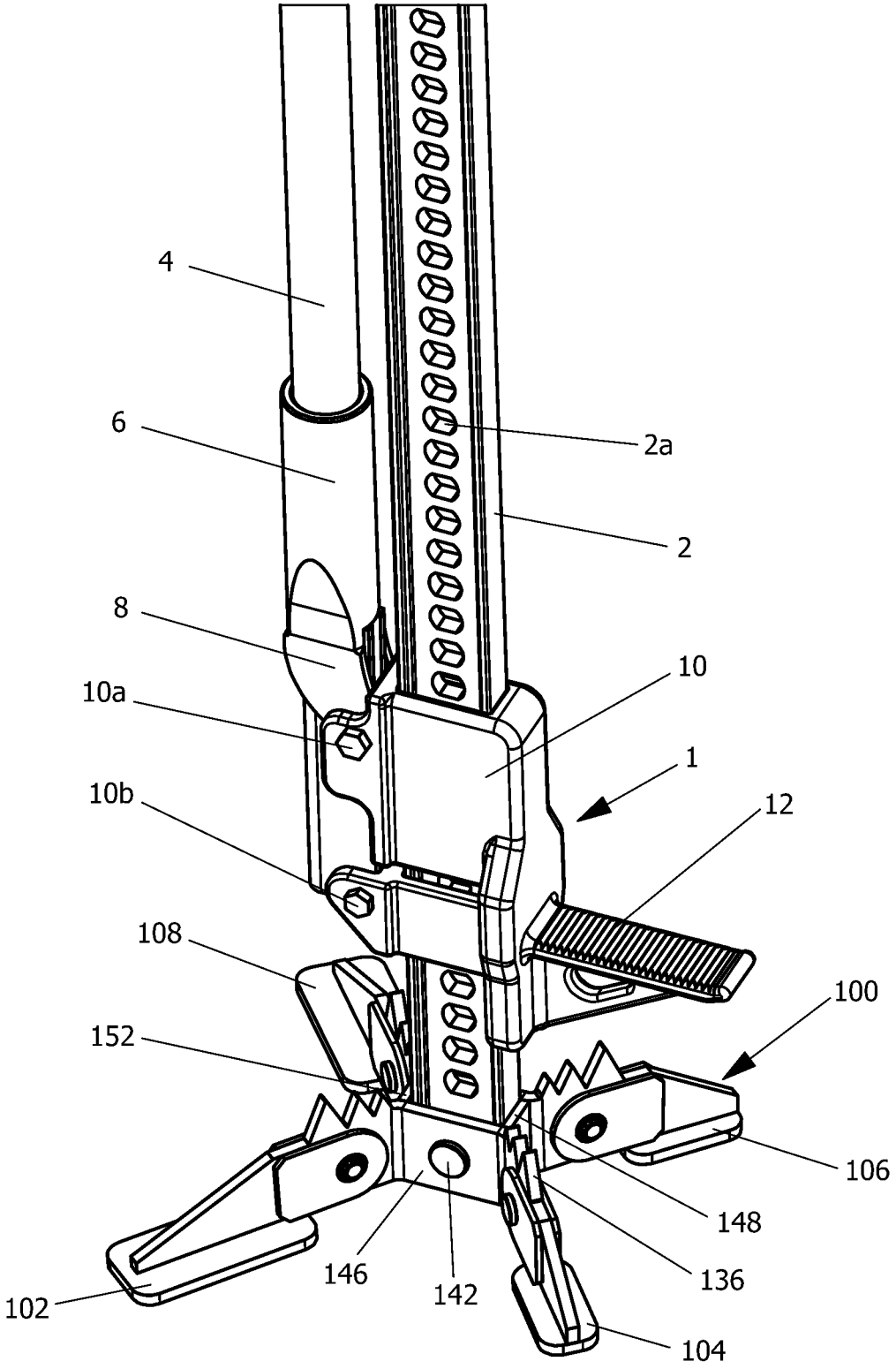
FIG. 3 shows a front, right side, and top perspective view of part of the farm jack of FIG. 1A and of the base of FIG. 1A, with the base of FIG. 1A in a flattened state, and placed on the farm jack so that two large plates of the base are situated to the left side of the farm jack and two small plates of the base situated to the right side of the farm jack, and with the base on a ground surface.

FIG. 3 shows a front, right side, and top perspective view of part of the farm jack 1 of FIG. 1A and of the base 100 of FIG. 1A, with the base 100 of FIG. 1A in a flattened state, and placed on the farm jack 1 so that the two large plates 102 and 108 of the base 100 are situated to the left side of the farm jack 1 and two small plates 104 and 106 of the base 100 are situated to the right side of the farm jack 1, and with the base 100 on the ground surface 200.

Figure 4:
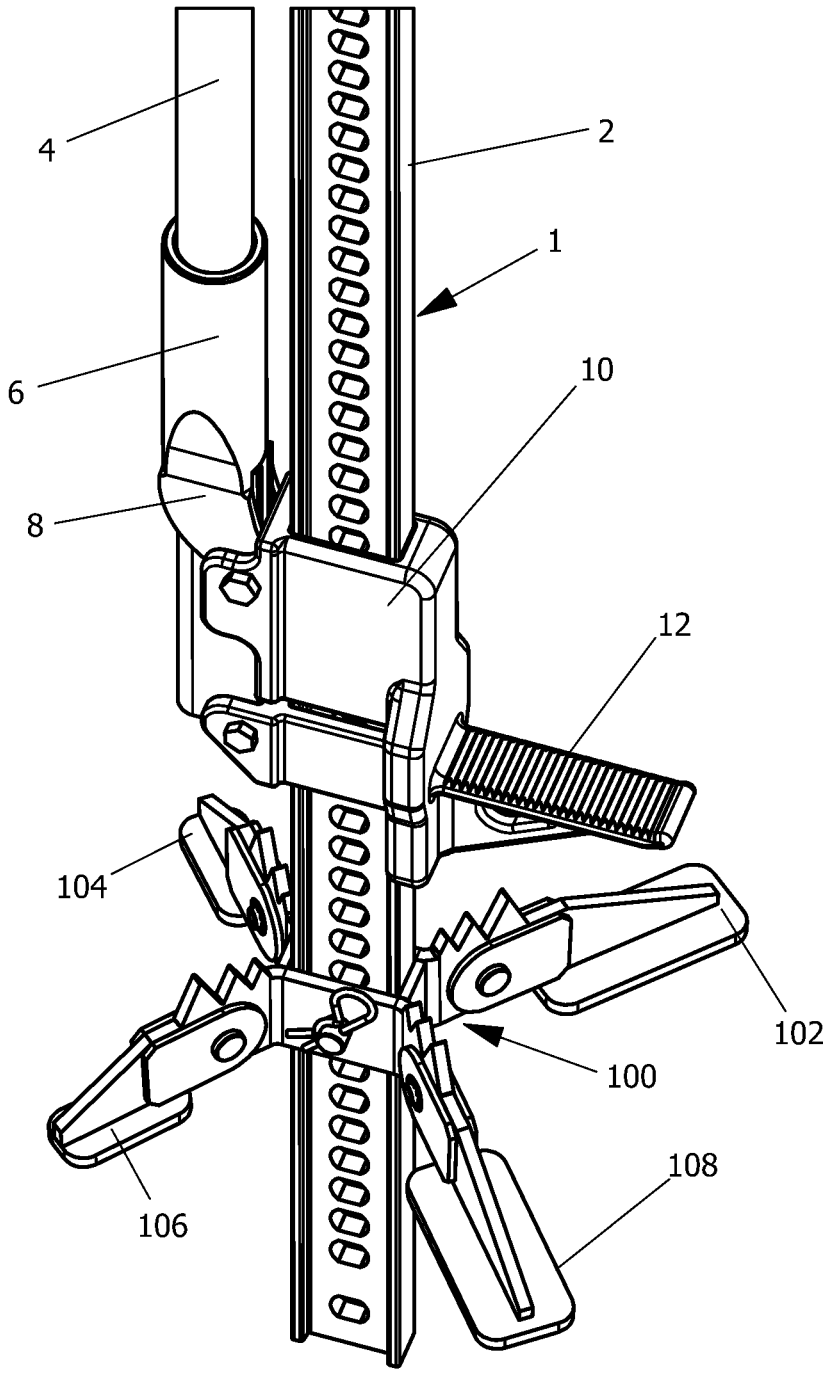
FIG. 4 shows a front, right side, and top perspective view of part of the farm jack of FIG. 1A and of the base of FIG. 1A, with the base of FIG. 1A in a flattened state, and placed on the farm jack so that two large plates of the base are situated to the right side of the farm jack and two small plates of the base situated to the left side of the farm jack, and with the base located upwards on a beam of the farm jack, above a ground surface.

FIG. 4 shows a front, right side, and top perspective view of part of the farm jack 1 of FIG. 1A and of the base 100 of FIG. 1A, with the base 100 of FIG. 1A in a flattened state, and placed on the farm jack 1 so that two large plates 102 and 108 of the base 100 are situated to the right side of the farm jack 1 and two small plates 104 and 106 of the base 100 situated to the left side of the farm jack 1, and with the base 100 located upwards on a beam 2 of the farm jack 1, above the ground surface 200.

Figure 5:
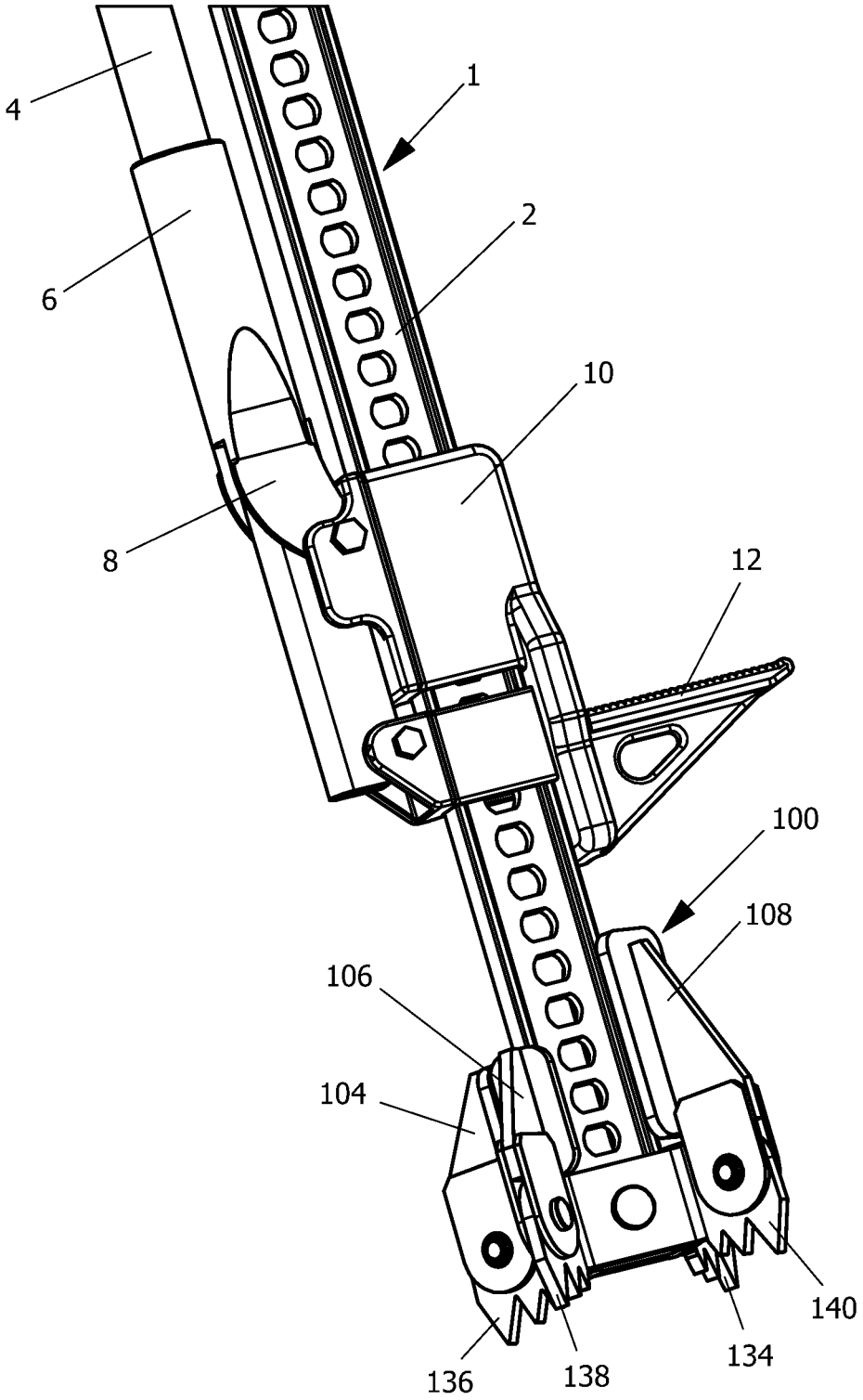
FIG. 5 shows a front, left side, and bottom perspective view of part of the farm jack of FIG. 1A and of the base of FIG. 1A, with the base of FIG. 1A in a folded upwards state, and placed on the farm jack so that two large plates of the base are situated to the right side of the farm jack and two small plates of the base situated to the left side of the farm jack, and with the base located upwards on a beam of the farm jack, at a lowest possible level.

FIG. 5 shows a front, left side, and bottom perspective view of part of the farm jack 1 of FIG. 1A and of the base 100 of FIG. 1A, with the base 100 of FIG. 1A in a folded upwards state, and placed on the farm jack 1 so that two large plates 102 and 108 of the base 100 are situated to the right side of the farm jack 1 and two small plates 104 and 106 of the base 100 situated to the left side of the farm jack 1, and with the base 100 located upwards on a beam 2 of the farm jack 1, at a lowest possible level.

Referring to FIGS. 1A-5, the base 100 includes plates 102, 104, 106, and 108, for example shown in FIG. 2, which may be made of a strong material such as steel, aluminum or a fiber/epoxy composite. The plates 102, 104, 106, and 108 may be considered to be or may be called foundation plates. The base 100 further includes members 110, 112, 114, and 116, members 118, 120, 122, and 124, pivot pins 126, 128, 130, and 132, members 134, 136, 138, and 140, rod 142 and cotter or split pin 144, and members 146, 148, 150, and 152. The members or plates 134, 136, 138, and 140 may be considered to be or may be called intermediate plates.

The plate 102 is fixed to the member 110 at a right angle. The member 110 may be triangular and may be fixed to the member 118. The member 118 has a circular opening which aligns with a circular opening of the member 134 and the member 118 is attached to the member 134, by pivot pin 126, so that the member 118 can rotate with respect to the member 134. The member 134 has triangular spikes on the top as shown in FIG. 2. The member 134 is fixed at a vertex of a rectangular structure including members 146, 148, 150, and 152. The member 134 is fixed at the location where members 152 and 146 are joined. The member 146 is fixed to the member 152 and the member 148 at right angles. The member 150 is fixed to the members 152 and 148 at right angles. Each of the components 102, 110, 118, 126, 134, and 146, 148, 150, and 152 may be made of a hard metal such as steel, aluminum, or other hard metal or material. The plates or members 110, 112, 114, and 116 may be considered to be or may be called further plates.

Similarly or identically the plate 104 is fixed to the member 112 at a right angle. The member 112 may be triangular and may be fixed to the member 120. The member 120 has a circular opening which aligns with a circular opening of the member 136 and the member 120 is attached to the member 136, by pivot pin 128 so that the member 120 can rotate with respect to the member 136. The member 136 has triangular spikes on the top as shown in FIG. 3. The member 136 is fixed at a vertex of a rectangular structure including members 146, 148, 150, and 152. The rectangular structure including members 146, 148, 150, and 152 may be considered to be and may be called a first section. The member 136 is fixed at the location where members 146 and 148 are joined. Each of the components 104, 112, 120, 128, and 136 may be made of a strong material such as steel, aluminum or a fiber/epoxy composite.

Similarly or identically the plate 106 is fixed to the member 114 at a right angle. The member 114 may be triangular and may be fixed to the member 122. The member 122 has a circular opening which aligns with a circular opening of the member 138 and the member 122 is attached to the member 138, by pivot pin 130 so that the member 122 can rotate with respect to the member 138. The member 138 has triangular spikes on the top as shown in FIG. 3. The member 138 is fixed at a vertex of a rectangular structure including members 146, 148, 150, and 152. The member 138 is fixed at the location where members 148 and 150 are joined. Each of the components 106, 114, 122, 130, and 138 may be made of a strong material such as steel, aluminum or a fiber/epoxy composite. Similarly or identically the plate 108 is fixed to the member 116 at a right angle. The member 116 may be triangular and may be fixed to the member 124. The member 124 has a circular opening which aligns with a circular opening of the member 140 and the member 124 is attached to the member 140, by pivot pin 132 so that the member 124 can rotate with respect to the member 140. The member 140 has triangular spikes on the top as shown in FIG. 2. The member 140 is fixed at a vertex of a rectangular structure including members 146, 148, 150, and 152. The member 140 is fixed at the location where members 150 and 152 are joined. Each of the components 108, 116, 124, 132, and 140 may be made of a strong material such as steel, aluminum or a fiber/epoxy composite. The rectangular structure including plates 146, 148, 150, and 152 is attached to the beam 2 by the rod 142 and the cotter or split pin 144, which is shown inserted through an opening in the rod 142 to hold the rectangular structure including plates 146, 148, 150 and 152 onto the beam 2. As shown in FIG. 2, the rod 142 has been inserted through one of the plurality of openings 2*a* of the beam 2 to fix the base 100 at a vertical height level on the beam 2.

The farm jack 1 may include the beam 2, a post 4, a member 6, a member 8, a carriage 10 and a step device 12. The member 8 may be pivotally connected to the carriage 10 by a device 10*a* such as including by a nut and bolt. The post 4 may be pivotally connected at by a device 10*b* to the carriage 10, such as including by a nut and bolt. The components 2, 4, 6, 8, 10, and 12 may be known components for a farm jack. Other components for a farm jack or any other jack or mechanical device may be provided in other embodiments of the present invention. Typically, a surface 12*a* of the step device 12 is placed under a vehicle, such as a car, and the pole 4 is rotated in the counterclockwise direction C1 shown in FIG. 1A, in order to jack up a car or other vehicle by gradually lifting up step device 12 in a known manner.

The base 100 can be taken off of the jack 1 by taking the cotter pin 144 out of the rod 142 and sliding the base 100 off of the beam 2. The base 100 can be placed on the beam 2 either with triangular spikes of members 134, 136, 138, and 140 facing up as in FIG. 2, or with the spikes of members 134, 136, 138, and 140 facing down as in FIG. 5. After the base 100 has been placed on the beam 2, in either a spikes up or down state, the plates 102, 104, 106, and 108 can be rotated into either a flattened state as shown in FIG. 2 or a state in which plates 102, 104, 106, and 108 are folded in against the beam 2 as shown in FIGS. 1A-1B, or in some intermediary between completely flattened and folded inwards.

In operation, the base 100 can be used in the spikes down position as shown in FIG. 5 to provide a base which can dig in and provide traction when the base 100 contacts a ground surface that is rough or uneven, or when one is unconcerned about damaging the ground surface. The base 100 can be used in a spikes up position as shown in FIG. 2, when one does not want the spikes to contact a ground surface, for example because of concerns about damaging the ground surface.

When used with the feet or plates 102, 104, 106, and 108 folded out or in a flattened state as in FIG. 2, the base 100 covers a large area and more safely supports the weight of the object being jacked up. This large "footprint" gives the farm jack 1 stability and a margin of safety that far exceeds the typical OEM (original equipment manufacturer) rectangular base typically provided for known jacks such as known farm jacks. The long front feet or plates 102 and 108 are directly vertical to the farm jack's nose or step device 12 eliminating the tendency for a "kick out". Positioning the short feet or plates 104 and 106 under the jack's nose or step device 12 and the long feet or plates 102 and 108 to the back side would be advantageous when jacking up a vehicle on a slope or hill, such as shown in FIG. 3. The large stable footprint of the base 100 allows the jack 1 to stand freely and prevents it from toppling over as is often the case with a known original equipment manufacturer base. The standard of the jack 1 may be allowed to extend through the base 100, opening up a variety of rigging possibilities should a reduced overall height be necessary as shown in FIG. 4. Open space between the feet or plates 102, 108, 104, and 106 allows the standard bar or beam 2 and nose or step device 12 to be positioned directly over and vertical to the object being lifted or pulled, as would be the case pulling a post from the ground.

One of the greatest strengths the base 100 in combination with the jack 1 or another known jack, is it's functionality with the feet or plates 102, 104, 106, and 108 folded up and used with the spike teeth down as shown in FIG. 5. Although the footprint is small with the spikes down, the ability to get a positive grip extends the safety and capability of the jack 1 well beyond the flat surface feet or OEM base. With the spikes down as in FIG. 5, the base 100 is able to grip into driftwood on the beach, logs in the woods and even hot asphalt on the road side. The base 100 is designed for impossibly difficult terrain features and four points of stable contact can be made on a smooth, round rock as small as a bowling ball. The small footprint of the base 100 with spikes down allows for a common recovery technique known as "drive off" where the vehicle is jacked up to clear an obstacle and literally driven off. The small footprint makes this a less dangerous operation.

Figure 6:
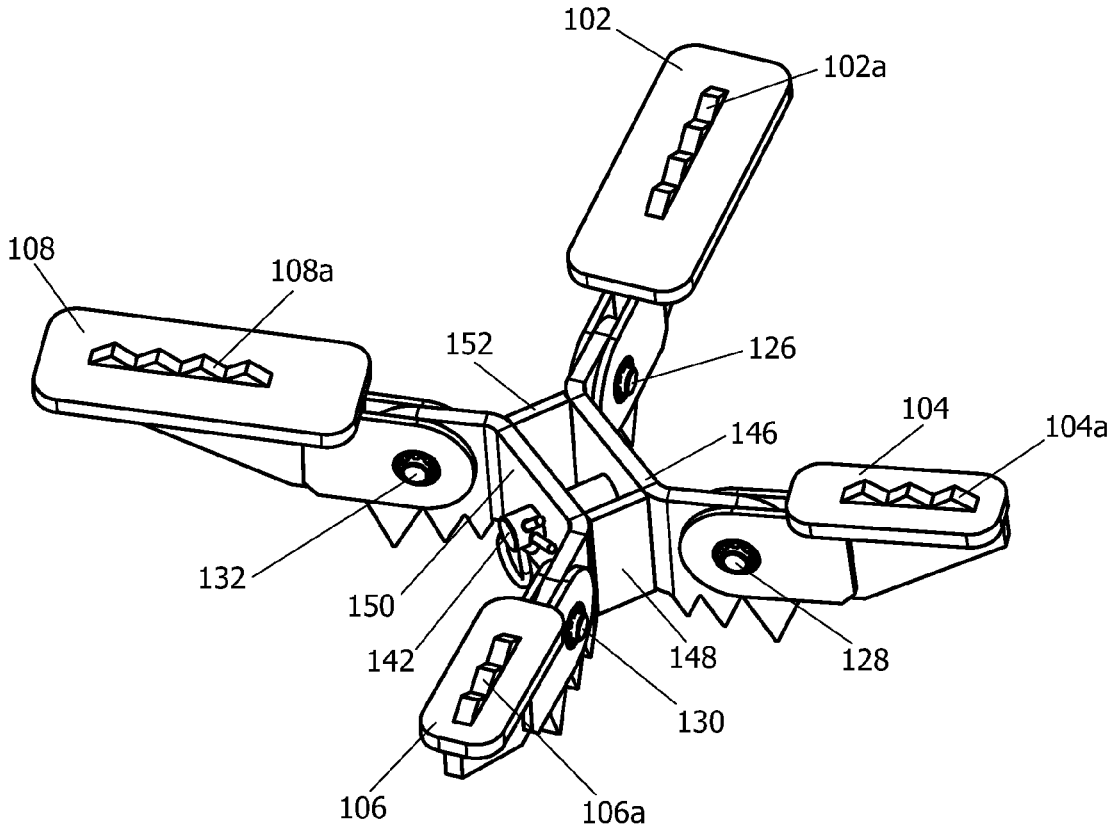
FIG. 6 shows a bottom, front, and left side view of the base of FIG. 1A, in a state where the base is upside down and flattened.

FIG. 6 shows a bottom, front, and left side view of the base 100 of FIG. 1A, in a state where the base is upside down and flattened. FIG. 6 also shows a plurality of triangular protrusions 108*a* fixed to and protruding out of the plate 108. Similarly, FIG. 6 also shows pluralities of triangular protrusions 102*a*, 104*a*, and 106*a* protruding out from plates 102, 104, and 106, respectively. These protrusions 102*a*, 104*a*, 106*a*, and 108*a* may be used to dig in to a surface such as dirt, sand, or any other surface to grip the surface to keep the base 100 from moving side to side and thus to keep the jack 1 from moving side to side. These protrusions 102*a*, 104*a*, 106*a*, and 108*a* may provide better gripping or friction on any surface, such as including hard surfaces, such as rocks or soft surfaces. These protrusions 102*a*, 104*a*, 106*a*, and 108*a* may be made of strong material such as steel, aluminum or a fiber/epoxy composite.

Figure 7:
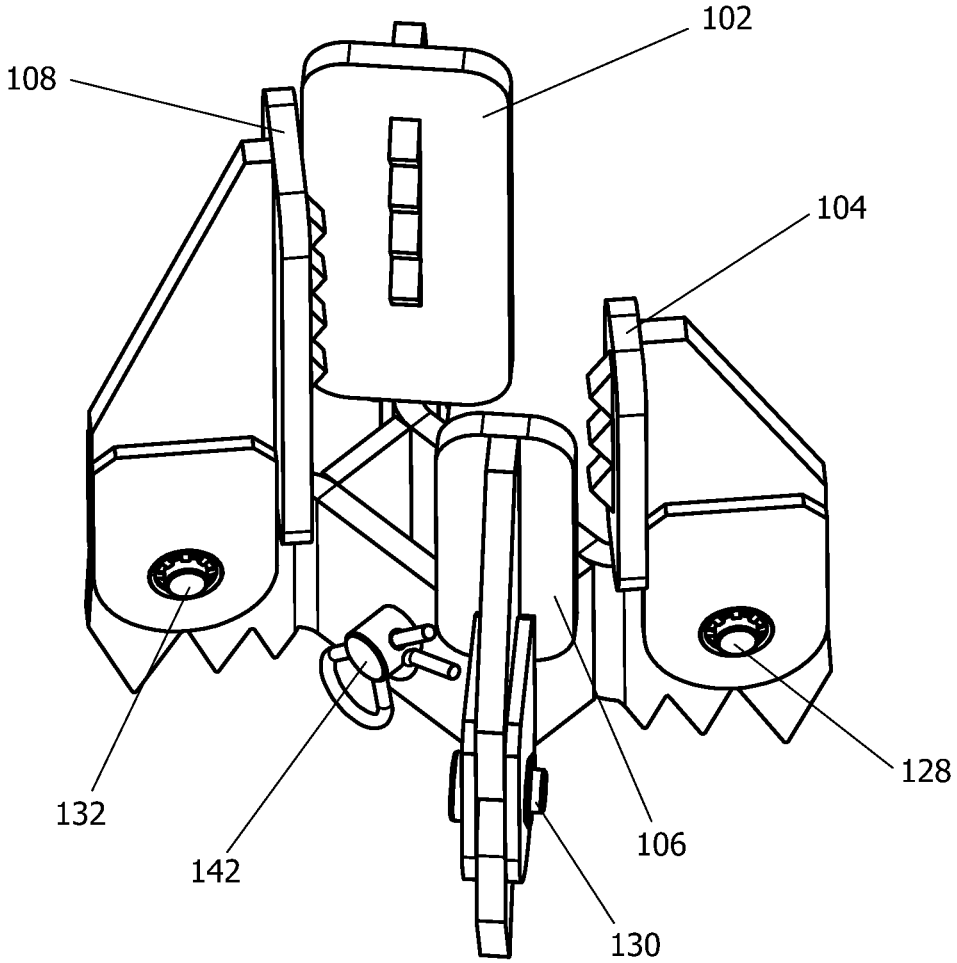
FIG. 7 shows a bottom, front, and left side view of the base of FIG. 1A, in a state where the base is upside down and folded upwards.

FIG. 7 shows a bottom, front, and left side view of the base 100 of FIG. 1A, in a state where the base 100 is upside down and folded upwards. In FIG. 7, the plates 102, 104, 106, and 108 have been rotated upwards about pins and/or fastening devices 126, 128, 130, and 132, respectively. This can be done to move the plates 102, 104, 106, and 108 out of the way for easy storage of the combination of jack 1 and base 100.

Figure 8:
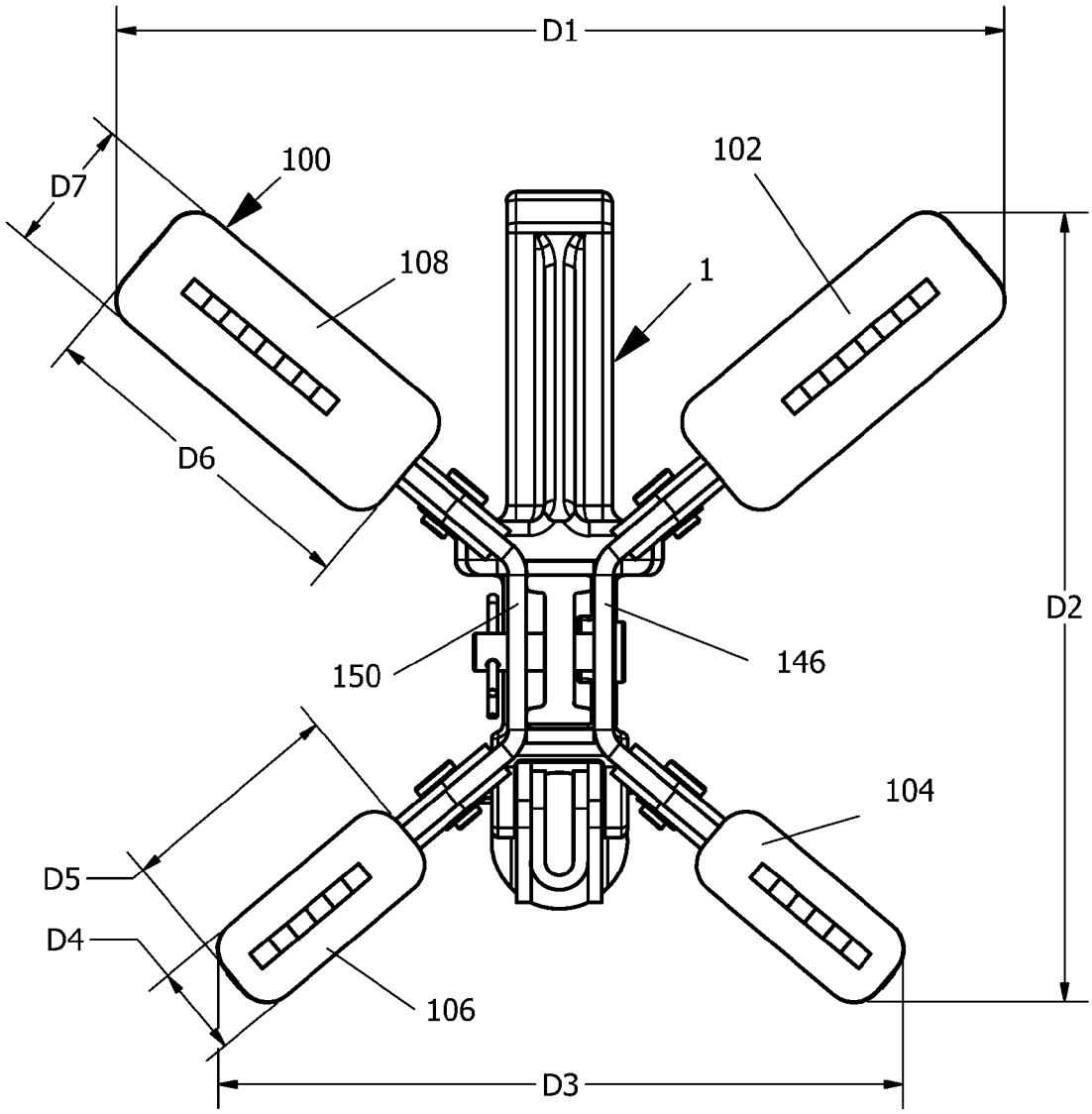
FIG. 8 shows a bottom view of the base of FIG. 1A, in a state wherein the base is flattened.

FIG. 8 shows a bottom view of the base 100 of FIG. 1A, in a state wherein the base 100 is flattened. In FIG. 8, the dimensions D1, D2, D3, D4, D5, D6, and D7, in at least one embodiments may be 11.8, 10.5, 9.1, 1.2, 3.0, 4.5, and 1.8 inches, respectively.

Figure 9:
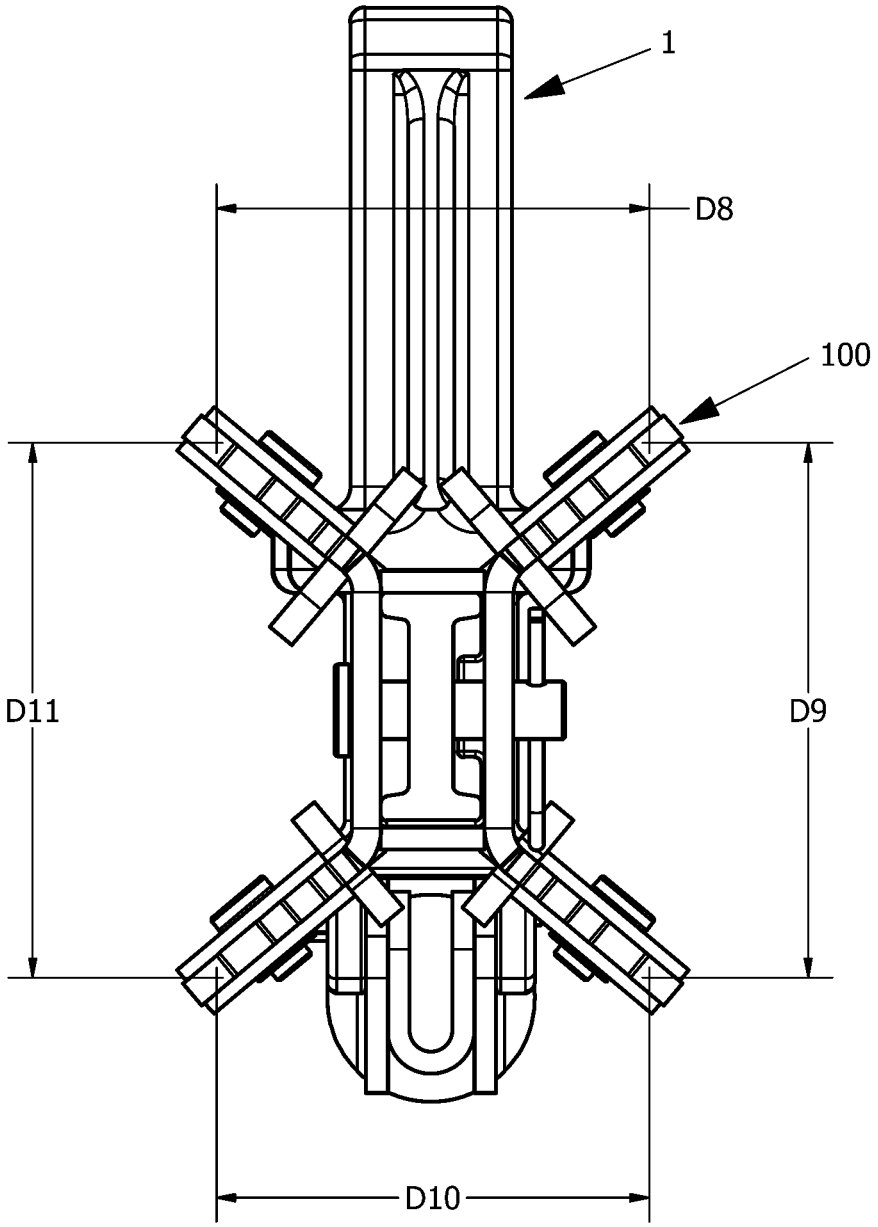
FIG. 9 shows a bottom view of the base of FIG. 1A, in a state wherein the base is folded upwards.

FIG. 9 shows a bottom view of the base 100 of FIG. 1A, in a state wherein the base 100 is folded upwards. In FIG. 9, the dimensions D8, D9, D10, and D11 may be 3.8, 4.6, 3.8, and 4.6 inches, respectively.

Generally speaking, HiLift (trademarked) and farm jacks have been a workhorse for firefighters and emergency responders for many years. With the base 100 spikes down as in FIG. 5, an emergency responder will be able to dig the teeth into a wooden or metal structure or a vehicle to aid in extraction. The base 100 extends the functionality of the common farm jack as an essential emergency rescue tool.

Storage of the combination of the farm jack 1 and the base 100 is made more flexible with the base 100 than prior combinations of jack and base. When the feet or plates 102, 104, 106, and 108 are folded up and positioned further up the standard or beam 2, as in FIG. 1A, the farm jack 1 now has a lower overall profile. Toolless assembly allows the user to not only make use mode configurations quickly and easily but it also allows for quick removal for flexible lower profile storage. Stowing the base 100 out of the weather is as easy as pulling its lock pin or cotter pin 144 from the rod 142 shown in FIG. 2.

Figure 10A:
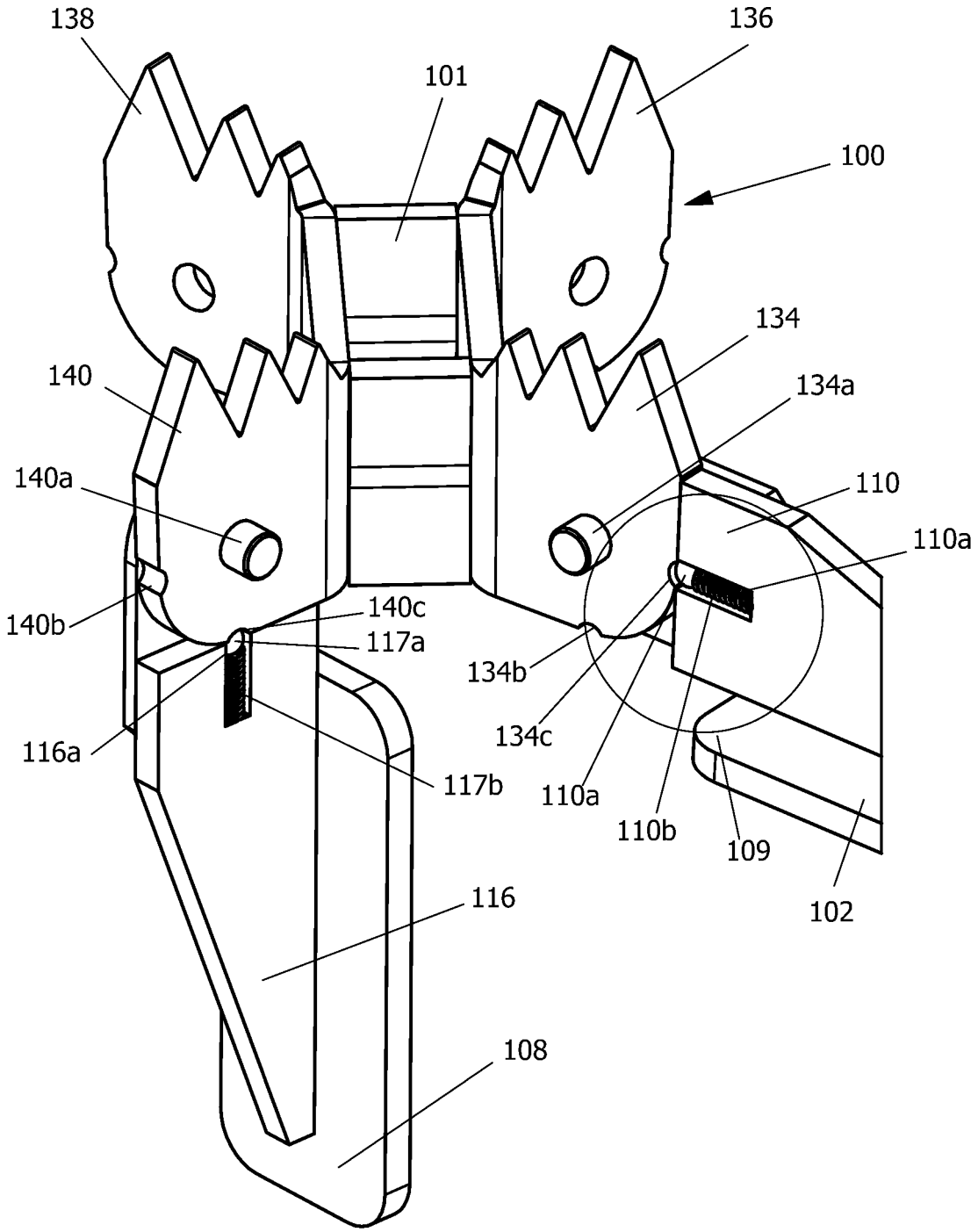
FIG. 10A shows a perspective view of a portion of the base on FIG. 1A in a state in which part of the base is folded and part of the base remains flat, and in which some of the components of the base of FIG. 1A have been removed.

FIG. 10A shows a perspective view of a portion of the base 100 in a state in which part of the base 1 is folded and part of the base 1 remains flat, and in which some components of the base 100 have been removed. The plate 108 has been folded downwards in FIG. 10A. The pin 132, and the plate 124 shown in FIG. 2 have been removed and are not shown in FIG. 10A. FIG. 10A shows protrusion or post 140*a*, notch 140*b*, and notch 140*c*. FIG. 10A also shows slot 116*a* in the plate 116, in which resides ball 117*a* and spring 117*b*. FIG. 10A also shows slot 110*a* in the plate 110, in which resides ball 111*a*, and spring 111*b* shown in detail in a closeup view in FIG. 10B. FIG. 10A also shows protrusion or post 134*a* on plate 134, and notches 134*b* and 134*c*.

Figure 10B:
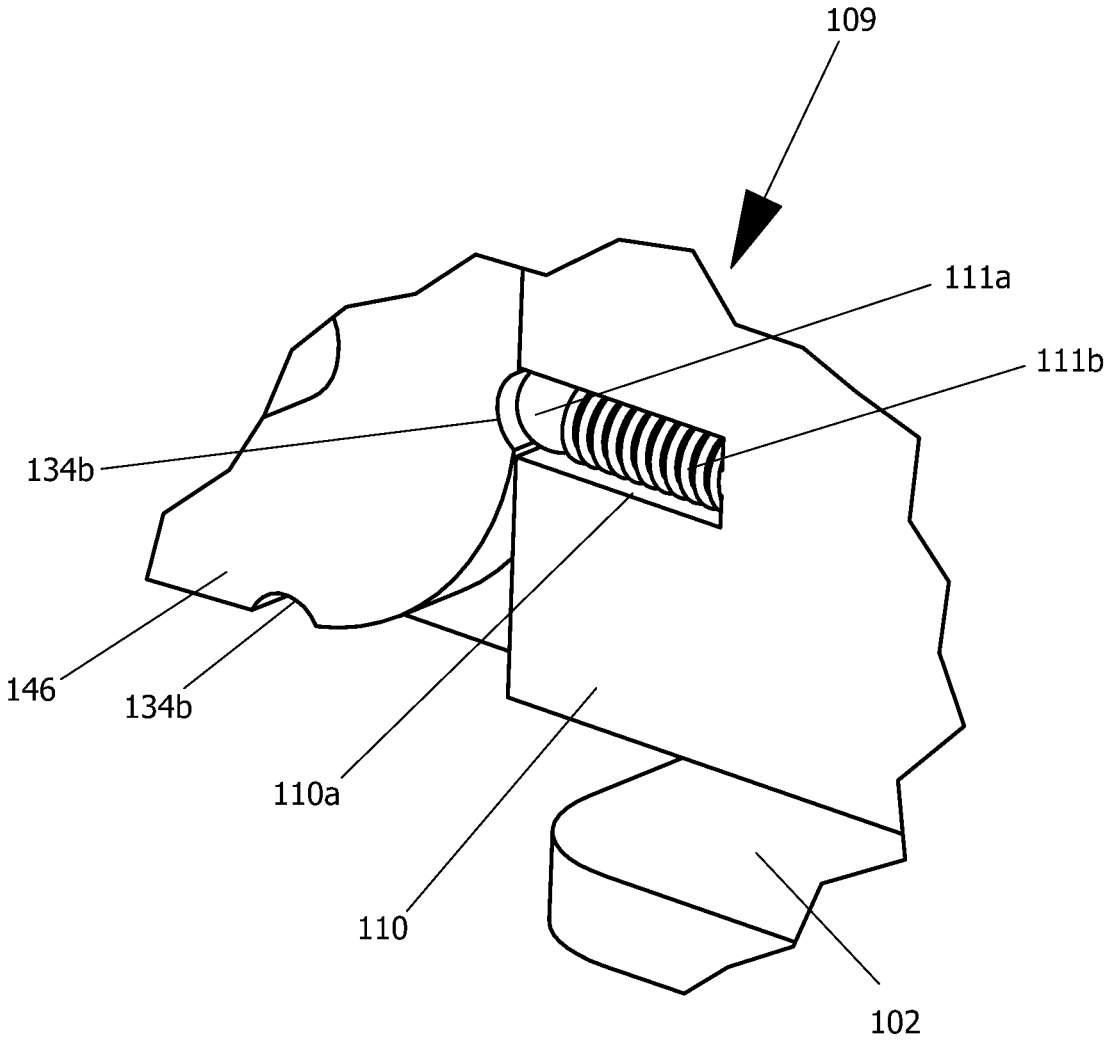
FIG. 10B shows a closeup of part of FIG. 10A.

In FIG. 10A and FIG. 10B, the ball 111*a* is shown currently in notch 134*b*. The ball 111*a* snaps into the notch 134*c*, by the action of spring 111*b* to hold the plate 102 in the flat position of FIG. 10A. The plate 102 can be moved out of the flat position and into a folded position, analogous to the position of plate 108 in FIG. 10A, by rotating the plates 102 and 110 clockwise from the position of FIG. 10A to a folded position in which the ball 111*a* snaps into the notch 134*b* by action of the spring 111*b*.

Each of the plates 112, 114, and 116 include a slot, a ball, and a spring analogous to the slot 110*a*, the ball 111*a*, and the spring 111*b* to allows rotation and snapping into position in a manner identical to or similar to the plate 110.

For example, In FIG. 10A, the ball 117*a* is shown currently in notch 140*c*. The ball 117*a* snaps into the notch 140*c*, by the action of spring 117*b* to hold the plate 108 in the folded position of FIG. 10A. The plate 108 can be moved out of the folded position and into a flat position, analogous to the position of plate 110 in FIG. 10A, by rotating the plates 108 and 116 counter clockwise from the position of FIG. 10A to a flat position in which the ball 117*a* snaps into the notch 140*b* by action of the spring 117*b*.

Note that the plate 118 and the pin 126 is not shown in FIG. 10A or FIG. 10B, for ease of description. The plate 118 is fixed to the plate 110 at one end and is rotatably mounted to the protrusion 134*a* by pin or connector or cap 126. Similarly or identically, the plate 120 is fixed to the plate 112 at one end and is rotatably mounted to a protrusion similar or analogous to protrusion 134*a* by pin or connector or cap 128. Similarly or identically, the plate 122 is fixed to the plate 114 at one end and is rotatably mounted to a protrusion similar or analogous to protrusion 134*a* by pin or connector or cap 130. Similarly or identically, the plate 124 is fixed to the plate 116 at one end and is rotatably mounted to protrusion 140*a* similar or analogous to protrusion 134*a* by pin or connector or cap 132.

Thus the feet or plates 102, 104, 106, and 108, in at least one embodiment lock into a state, such as for example, the flattened state of FIG. 2 or the folded state of FIG. 7, by use of a ball and spring which may be part of each of components 110, 112, 114, and 116 as shown and described above.

Figure 11A:
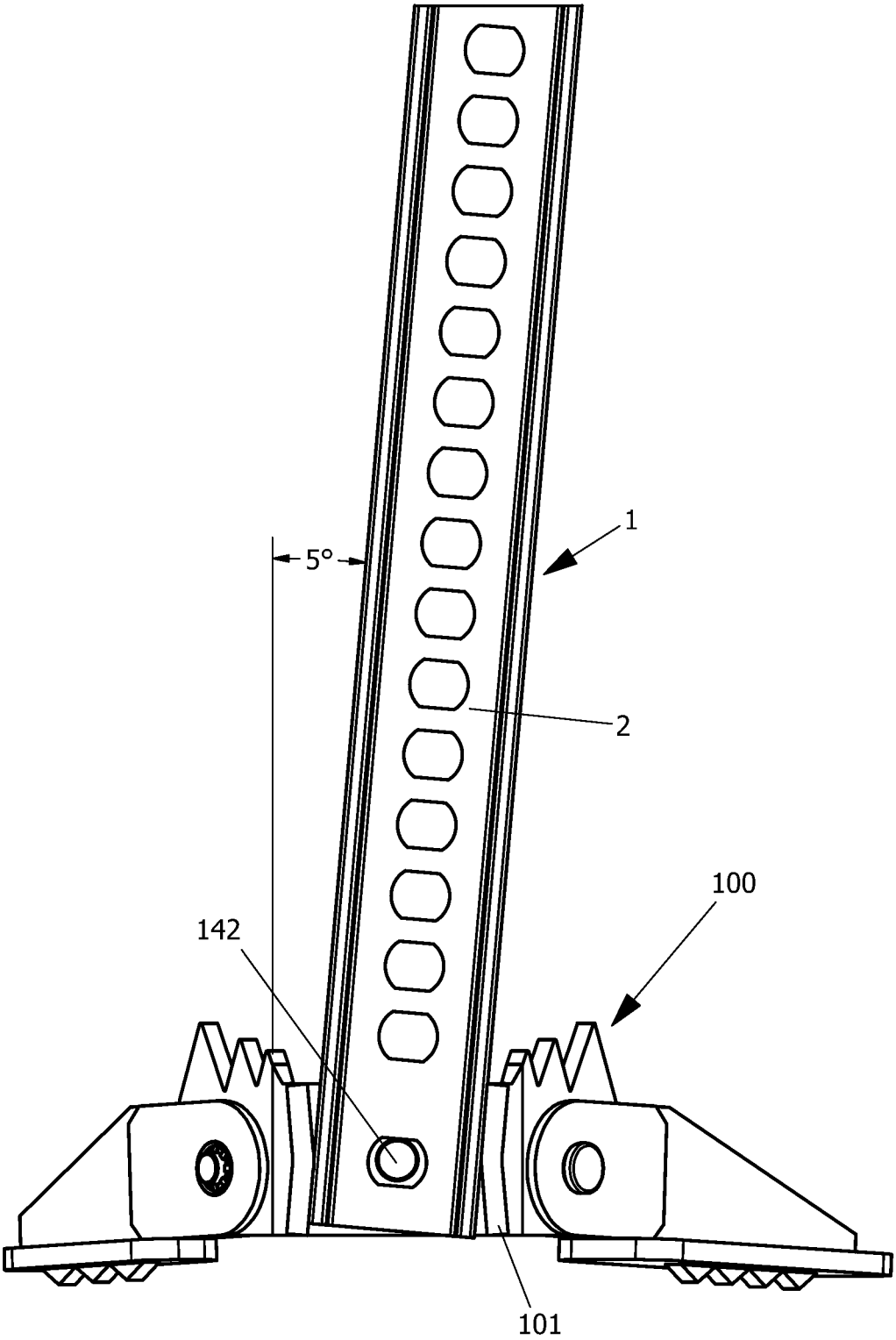
FIG. 11A shows a beam of the farm jack of FIG. 1A in first orientation.
Figure 11B:
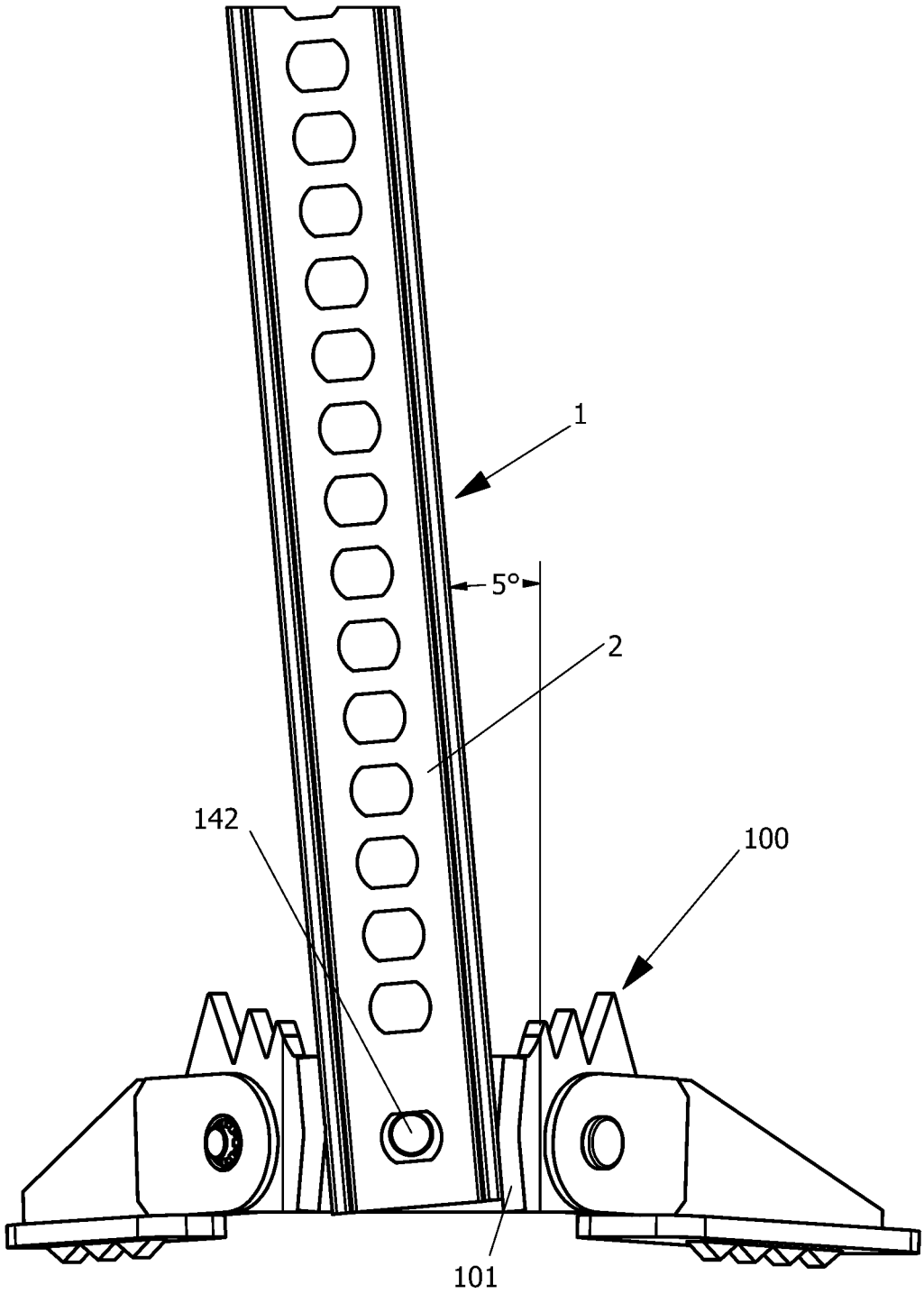
FIG. 11B shows the beam, referred to in FIG. 11A, of the farm jack of FIG. 1A in a second orientation.

FIG. 11A shows the beam 2 of the farm jack 1 of FIG. 1A in first orientation. FIG. 11B shows the beam 1, referred to in FIG. 11A, of the farm jack 1 of FIG. 1A in a second orientation. There is clearance in the base 100 shown by FIGS. 11A-B where the beam 2 of the farm jack 1 passes through a typically square opening 101 shown in FIG. 10A of the base 100. The entire base 100 can pivot about pin 142, within the opening 101 to adjust slightly to uneven terrain.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. An apparatus comprising:

a lifting jack having a beam;

a base having a first section with a first opening configured to receive the beam;

wherein the base further includes one or more foundation plates connected to the first section in a manner so that each of the one or more foundation plates can be rotated with respect to the first section;

wherein the one or more foundation plates includes a first foundation plate, a second foundation plate, a third foundation plate, and a fourth foundation plate;

wherein the first foundation plate and the second foundation plate are about the same size and shape;

the third foundation plate and the fourth foundation plate are about the same size and shape;

and the first foundation plate and the third foundation plate are substantially different in size.

2. An apparatus comprising:

a base having a first section with a first opening configured to receive a beam; and wherein the base further includes one or more foundation plates connected to the first section in a manner so that each of the one or more foundation plates can be rotated with respect to the first section;

wherein the one or more foundation plates includes a first foundation plate, a second foundation plate, a third foundation plate, and a fourth foundation plate;

wherein the first foundation plate and the second foundation plate are about the same size and shape;

the third foundation plate and the fourth foundation plate are about the same size and shape;

and the first foundation plate and the third foundation plate are substantially different in size.

3. An apparatus comprising:

a base having a first section with a first opening configured to receive a beam;

wherein the base further includes one or more foundation plates connected to the first section in a manner so that each of the one or more foundation plates can be rotated with respect to the first section;

further comprising one or more intermediate plates corresponding to the one or more foundation plates, such that there is one intermediate plate for each foundation plate;

wherein each intermediate plate of the one or more intermediate plates is fixed to the first section so that each intermediate plate cannot rotate with respect to the first section;

and wherein each intermediate plate is connected to its corresponding foundation plate so that its corresponding foundation plate can rotate with respect to its intermediate plate and with respect to the first section.

4. The apparatus of claim 1 wherein each of the one or more foundation plates has a bottom surface, from which protrude a plurality of protrusions.

5. An apparatus comprising:

a lifting jack having a beam;

a base having a first section with a first opening configured to receive the beam;

wherein the base further includes one or more foundation plates connected to the first section in a manner so that each of the one or more foundation plates can be rotated with respect to the first section;

further comprising one or more intermediate plates corresponding to the one or more foundation plates, such that there is one intermediate plate for each foundation plate;

wherein each intermediate plate of the one or more intermediate plates is fixed to the first section so that each intermediate plate cannot rotate with respect to the first section;

and wherein each intermediate plate is connected to its corresponding foundation plate so that its corresponding foundation plate can rotate with respect to its intermediate plate and with respect to the first section.

6. The apparatus of claim 5 wherein the one or more foundation plates includes a first foundation plate, a second foundation plate, a third foundation plate, and a fourth foundation plate;

and wherein the one or more intermediate plates include a first, a second, a third, and a fourth intermediate plate corresponding to the first, the second, the third, and the fourth foundation plates, respectively.

7. The apparatus of claim 5 wherein each of the one or more intermediate plates includes protrusions.

8. The apparatus of claim 7 wherein the protrusions of each of the one or more intermediate plates are triangular spikes.

9. The apparatus of claim 5 wherein each of the intermediate plates has at least one notch which allows its corresponding foundation plate to be snapped into at least one orientation with respect to the intermediate plate and with respect to the first section.

10. The apparatus of claim 9 further comprising one or more further plates fixed to the one or more foundation plates, such that there is one further plate for each corresponding foundation plate;

wherein each of the one or more further plates is fixed substantially perpendicular to its corresponding foundation plate; and wherein each of the one or more further plates is connected to a corresponding one of the one or more intermediate plates so that the one or more further plates can rotate with respect to its corresponding one of the one or more intermediate plates, and with respect to the first section.

11. The apparatus of claim 10 wherein each of the one or more further plates includes a slot having a ball and a spring;

and wherein the ball of each of the one or more further plates snaps into the at least one notch of the corresponding one of the one or more intermediate plates by action of the spring, in order to snap the corresponding one of the one or more foundation plates into the at least one orientation with respect its corresponding intermediate plate and with respect to the first section.

12. A method comprising:

placing a base of an apparatus on a ground surface;

wherein the apparatus includes a lifting jack having a beam; and further comprising using the lifting jack to lift up a vehicle while the base of the apparatus is on the ground surface;

wherein the base of the apparatus has a first section with a first opening configured to receive the beam;

wherein the base further includes one or more foundation plates connected to the first section in a manner so that each of the one or more foundation plates can be rotated with respect to the first section;

wherein the one or more foundation plates includes a first foundation plate, a second foundation plate, a third foundation plate, and a fourth foundation plate;

wherein the first foundation plate and the second foundation plate are about the same size and shape;

the third foundation plate and the fourth foundation plate are about the same size and shape;

and the first foundation plate and the third foundation plate are substantially different in size.

13. The method of claim 12 wherein each of the one or more foundation plates has a bottom surface, from which protrude a plurality of protrusions.

14. A method comprising:

placing a base of an apparatus on a ground surface;

wherein the apparatus includes a lifting jack having a beam; and further comprising using the lifting jack to lift up a vehicle while the base of the apparatus is on the ground surface;

wherein the base of the apparatus has a first section with a first opening configured to receive the beam;

wherein the base further includes one or more foundation plates connected to the first section in a manner so that each of the one or more foundation plates can be rotated with respect to the first section;

wherein the apparatus includes one or more intermediate plates corresponding to the one or more foundation plates, such that there is one intermediate plate for each foundation plate;

wherein each intermediate plate of the one or more intermediate plates is fixed to the first section so that each intermediate plate cannot rotate with respect to the first section;

and wherein each intermediate plate is connected to its corresponding foundation plate so that its corresponding foundation plate can rotate with respect to its intermediate plate and with respect to the first section.

15. The method of claim 14 wherein the one or more foundation plates includes a first foundation plate, a second foundation plate, a third foundation plate, and a fourth foundation plate;

and wherein the one or more intermediate plates include a first, a second, a third, and a fourth intermediate plate corresponding to the first, the second, the third, and the fourth foundation plates, respectively.

16. The method of claim 14 wherein each of the one or more intermediate plates includes protrusions.

17. The method of claim 14 wherein each of the intermediate plates has at least one notch which allows its corresponding foundation plate to be snapped into at least one orientation with respect to the intermediate plate and with respect to the first section.

18. The method of claim 16 wherein the protrusions of each of the one or more intermediate plates are triangular spikes.

19. The method of claim 18 further comprising orienting the apparatus so that the protrusions of each of the one or more intermediate plates contact a ground surface and the one or more foundation plates do not contact the ground surface.

20. The method of claim 18 further comprising orienting the apparatus so that the protrusions of each of the one or more intermediate plates do not contact a ground surface and the one or more foundation plates contact the ground surface.

* * * * *